United States Patent [19]

Murakami

[11] 4,123,078

[45] Oct. 31, 1978

[54] BABY WALKER WITH DEVICE FOR SUPPORTING STEM FOR BEADS

[75] Inventor: Mitsuo Murakami, Higashi-Osaka, Japan

[73] Assignee: Kabushiki Kaisha Famy, Osaka, Japan

[21] Appl. No.: 726,159

[22] Filed: Sep. 24, 1976

[51] Int. Cl.[2] ..... A47D 13/04

[52] U.S. Cl. ..... 280/87.02 W; 46/32

[58] Field of Search ..... 46/32, 1 R, 130, 175 R, 46/193, 177; 35/31 B, 32, 33; 235/123; 63/2; 272/70.3, 70.4; 280/87.02 W, 87.03; 297/5, 6

[56] References Cited

U.S. PATENT DOCUMENTS

| | | | |
|---|---|---|---|
| 1,738,858 | 12/1929 | White | 280/87.02 W |
| 1,872,216 | 8/1932 | Appleby | 280/87.02 W X |
| 2,301,673 | 11/1942 | Allen | 46/193 |
| 2,330,538 | 9/1943 | Allen | 46/32 X |
| 2,411,614 | 11/1946 | Cohen | 35/32 X |
| 2,574,897 | 11/1951 | Tantimonaco | 272/70.4 |
| 2,576,439 | 11/1951 | Beck et al. | 46/1 R |
| 3,504,927 | 4/1970 | Seki | 297/5 X |
| 3,796,430 | 3/1974 | Sudo | 272/70.3 |
| 3,811,205 | 5/1974 | Pitzler | 35/32 |

FOREIGN PATENT DOCUMENTS

| | | | |
|---|---|---|---|
| 820,386 | 7/1937 | France | 35/33 |
| 954,259 | 4/1964 | United Kingdom | 46/193 |

*Primary Examiner*—F. Barry Shay

*Attorney, Agent, or Firm*—Koda and Androlia

[57] ABSTRACT

The ends of a stem on which a number of beads are rotatably and slidably mounted are supported by support members provided on a baby walker. The support members are each formed with a support hole having a small diameter portion and a large diameter portion which differ in inner diameter. After the ends of the stem are inserted from the small diameter portion side, a bulge is formed on each end of the stem. Thus, the stem is fitted in the small diameter portions and the bulges are grasped by the large diameter portions, so that there is no possibility of the stem slipping off the support holes. Further, there is no possibility of the bulges on the stem being exposed outside the support members.

1 Claim, 4 Drawing Figures

BABY WALKER WITH DEVICE FOR SUPPORTING STEM FOR BEADS

BACKGROUND OF THE INVENTION

The present invention relates to a device for supporting a stem carrying such ornamental beads for amusement for babies as those provided on playthings for babies, for example, a baby walker, or on babies' furniture.

As for ornamental beads for amusement for babies, conventionally, a stem on which a number of such beads are rotatably and slidably mounted is supported by support members which are fixed, for example, on the tray of a baby walker. Thus, the baby can amuse itself by rotating or sliding the beads on the stem. Said support members are disposed at the opposite ends of the stem and adapted to support the stem at the opposite ends thereof by receiving said ends in blind holes provided in said support members. Therefore, when the baby grips the intermediate portion of the stem and pulls it, the stem is bent and liable to have its ends disengaged from the blind holes in the support members. The stem has no surface-protective treatment applied to its ends, thus involving the danger of the baby injuring its body on said non-treated ends. Further, as is known, babies have a habit of putting anything it can lay hands on in their mouth, and hence there is a danger that they will put beads released from the stem in their mouth and swallow the same.

SUMMARY OF THE INVENTION

An object of the present invention is to provide a safe device which precludes the possibilty of the stem being disengaged to cause injury to babies or of beads being released and put in babies' mouth.

Another object of the invention is to provide a safe device wherein the ends of the stem supported by support members are prevented from being exposed outside the support members so as to protect babies against injuries.

A further object of the invention is to provide a device allowing easy assembly of the support members and stem. Other objects, features and merits of the invention will become more apparent from the following description with reference to the accompanying drawing.

DESCRIPTION OF THE PREFERRED EMBODIMENT

Figure 1:
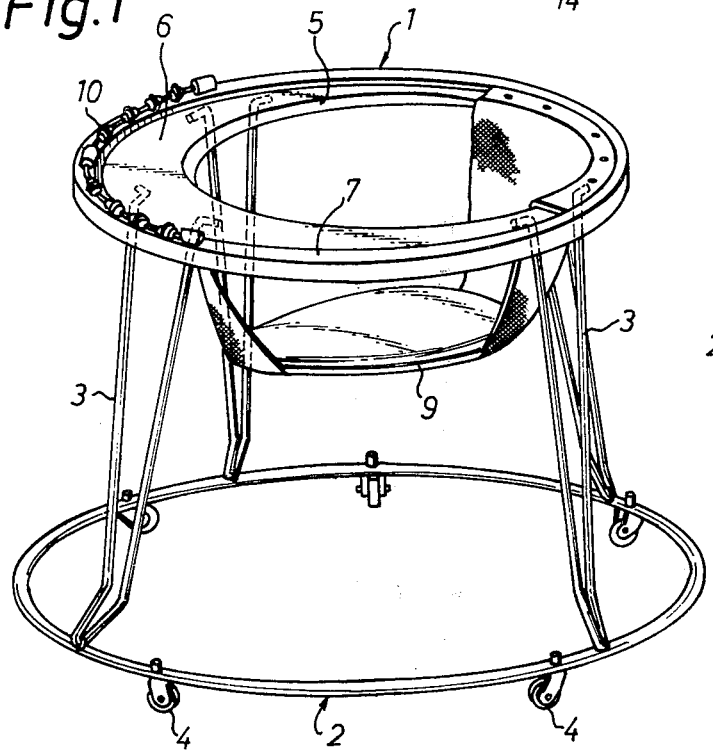
FIG. 1 is a perspective view of a baby walker to which an example of the present invention is applied.

FIG. 1 shows an example in which the present invention is applied to a baby walker. A round table 1 made of a plastic and an annular frame 2 of larger diameter than that of said table are coaxially connected together, one above the other, by legs 3. The frame 2 has casters 4 attached to the underside thereof for free travel. The table 1 has an opening 5 offset toward the rear, while the forward region of said table 1 is formed with a tray 6 and the peripheral edge of said table is formed with a peripheral ridge 7 of substantially inverted U-shaped cross-section integral therewith. The inner surface of said peripheral ridge 7 is formed with radial reinforcing ribs 8. A saddle 9 is suspended under said opening 5. When a baby is seated on the saddle 9, the baby's trunk is held in the table 1 by the opening 5. As the baby walks on the floor, the walker is driven on the casters 4.

Figure 2:
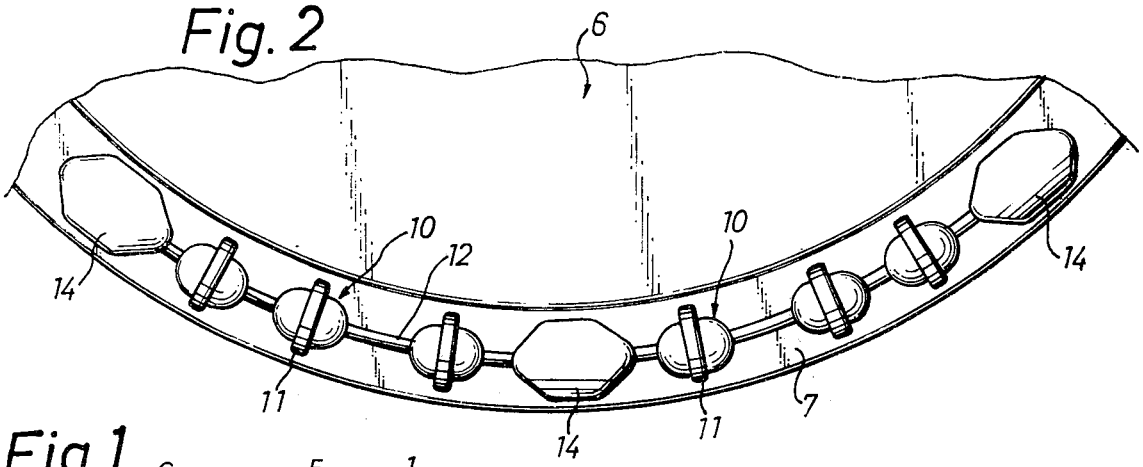
FIG. 2 is an enlarged plan view of an ornamental bead device shown in FIG. 1.
Figure 3:
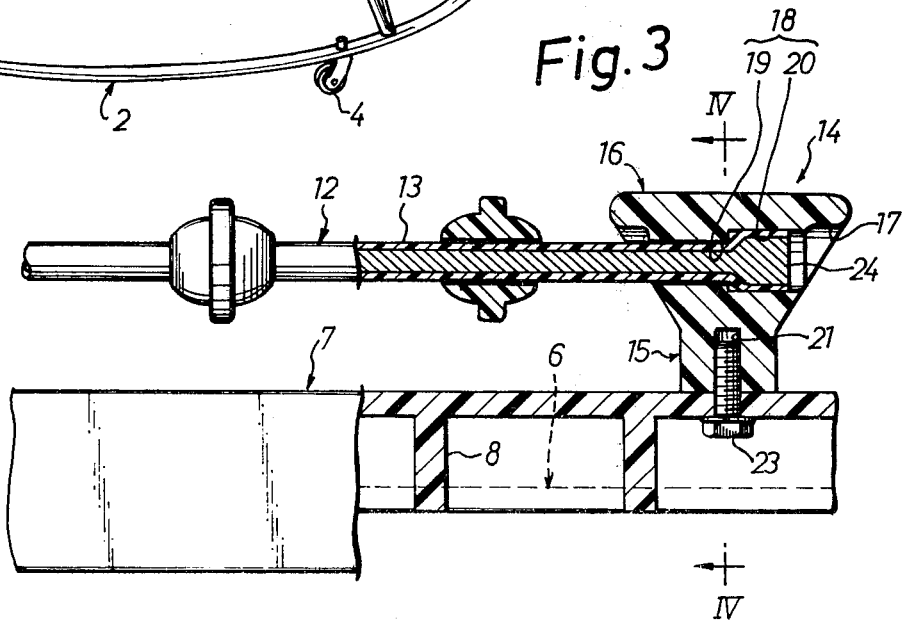
FIG. 3 is an enlarged front view, in section, of a support device.

Mounted on the peripheral ridge 7 forming the peripheral edge of the tray 6 are ornamental beads 10 for amusement. As shown in FIG. 2, the ornamental beads 10 are substantailly in the form of spheres each having a peripheral ridge 11 and multi-colored. A stem 12 shaped arcuate to extend along said peripheral ridge 7 is inserted in said ornametal beads 10. The stem 12, as shown in FIG. 3, is composed of a core rod covered with a plastic tube 13, providing an improved aesthetic effect and facilitating the rotation and slide movement of the beads 10 on the stem 12. The stem 12 is supported at its middle and ends by support members 14 fixed to the peripheral ridge 7 in the front region of the tray 6.

Figure 4:
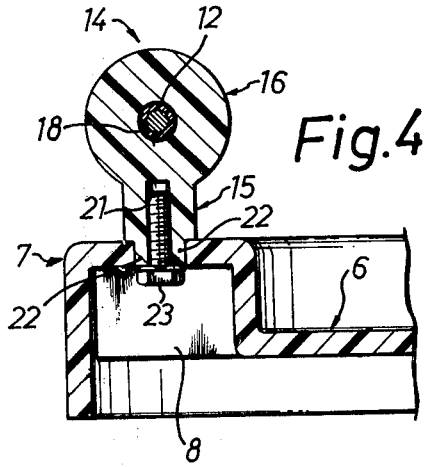
FIG. 4 is a section taken along the line IV—IV of FIG. 3.

FIGS. 3 and 4 show such support member according to a preferred embodiment of the invention. The support member 14 is formed of a plastic, comprising a trunk portion 15 of cylindrical cross-section and a head portion 16 of cylindrical cross-section extending at right angles with said trunk portion 15, said head portion 16 being provided with eaves 17 on the upper halves of the peripheral edges on the opposite end surfaces thereof. The head portion 16 is formed with an axially extending support hole 18 having a small diameter portion 19 and a large diameter portion 20 which differ in inner diameter and which concentrically communicate with each other. The trunk portion 15 is formed with an upwardly axially extending threaded hole 21 and rotation-preventive projections 22, 22 on the lower surface thereof disposed diametrically outside said threaded hole 21. On the other hand, the peripheral ridge of the tray 6 is formed with elongated holes adapted to receive the projections 22 so as to prevent the rotation of the support member 14, with a bolt screwed into the threaded hole 21 upwardly from below the ridge 7 to fix the support member 14 to said ridge 7. After one end of the stem is inserted into the support hole 18 from the small diameter portion side until it appears in the large diameter portion, a bulge 24 is formed on said end, as by hammering the latter in the case of the illustrated example, whereupon the stem is pulled from the large diameter portion toward the small diameter portion to allow the bulge 24 to be grasped by the large diameter portion 20. The other end of the stem 12 is supported by its associated support member 14 in exactly the same manner, while the intermediate portion of the stem 12 extends through the support hole 18 of its associated support member 14, which is of the same construction as that of said end support members 14. Therefore, the stem has its bulges 24 locked by the steps in the support holes at the junction between the different diameters, so that there is no possibility of the stem being disengaged from the support holes 18 in the pulling-out direction. Further, with the stem 12 supported at its opposite ends in the same manner, there is no possibility of the stem sliding in the support holes 18 and of the bulges 24 being exposed outside the support members 14.

According to the present invention, when a baby is amusing itself by rotating or sliding the ornamental beads on the stem, there is no possibility of the stem coming off even if the baby grips the stem and pulls it.

Therefore, the safety of the baby is assured as there is no possibility of the ends of the stem coming off the support members to cause injury to the baby or of ornamental beads released from the stem being put in the baby's mouth and swallowed. Further, with the stem inserted in the support members, the ends of said stem are prevented from being exposed to the ouside and hence there is no possibility that the baby will touch said ends and be injured thereby. Further, in assembly, it is only necessary to insert the stem into the support holes and form bulges and to secure said support members to the peripheral ridge, thus facilitating the assembly of the stem and support members. In addition, the assembling operation can be accelerated and facilitated if the formation of the bulges is performed by hammering as in the illustrated embodiment, but the invention is not limited to the illustrated embodiment and such bulges may be formed by any other means including nuts being threadedly fitted on the ends of the stem. Further, the support device of the invention is not limited in application to a baby walker, and it may be used for supporting a stem carrying ornamental beads thereon used on babies' beds or furniture or playthings in general.

I claim:

1. A baby walker comprising a table (1) providing a tray (6) and an opening (5) under which a saddle (9) is suspended; said table (1) being formed with a peripheral ridge (7) of substantially inverted U-shaped cross-section integral therewith, the inner surface of said ridge being formed with radial reinforcing ribs (8); legs (3) for supporting said table (1) on a frame (2) having casters (4) thereon; a stem (12) for carrying ornamental beads (10) comprising a core rod covered by a plastic tube (13) and having a bulge (24) formed on each end thereof; support means comprising, at each said end, a support member (14) for supporting said stem (12), a number of ornamental beads (10) rotatably slidably mounted on said stem, said support member being formed with a head portion (16) and a trunk portion (15); said trunk portion (15) being mounted on said ridge (7) with rotation-preventive projections (22) adapted to a hole of said ridge (7) so as to prevent the rotation thereof; said head portion (16) being formed with a support hole (18) for receiving an end of said stem (12) said support hole (18) having a small diameter portion (19) and a large diameter portion (20) which differ in inner diameter, said small diameter portion (19) snugly receiving said stem (12), said large diameter portion (20) serving to grasp said bulge (24) formed on said end of stem (12), said bulge (24) being locked by the step in said support hole (18) at the junction between the different diameters.

* * * * *